US008970474B2

(12) United States Patent
Lim et al.

(10) Patent No.: US 8,970,474 B2
(45) Date of Patent: Mar. 3, 2015

(54) METHOD FOR DRIVING ELECTROPHORESIS DISPLAY DEVICE

(75) Inventors: KyoungHo Lim, Yongin-si (KR); Cheolwoo Park, Suwon-si (KR); Uk chul Choi, Cheonan-si (KR); JongHee Kim, Hwaseong-si (KR); Hyun Sik Hwang, Ansan-si (KR)

(73) Assignee: Samsung Display Co., Ltd. (KR)

( * ) Notice: Subject to any disclaimer, the term of this patent is extended or adjusted under 35 U.S.C. 154(b) by 346 days.

(21) Appl. No.: 13/276,654

(22) Filed: Oct. 19, 2011

(65) Prior Publication Data

US 2012/0223928 A1 Sep. 6, 2012

(30) Foreign Application Priority Data

Mar. 4, 2011 (KR) ..... 10-2011-0019553

(51) Int. Cl.
*G09G 5/00* (2006.01)
*G09G 3/34* (2006.01)

(52) U.S. Cl.
CPC ..... *G09G 5/00* (2013.01); *G09G 3/344* (2013.01); *G09G 3/34* (2013.01)
USPC ..... 345/107

(58) Field of Classification Search
CPC ..... G09G 3/34; G09G 3/344
USPC ..... 345/107
See application file for complete search history.

(56) References Cited

U.S. PATENT DOCUMENTS

| | | | | |
|---|---|---|---|---|
| 8,174,492 | B2 * | 5/2012 | Kim et al. | 345/107 |
| 2002/0005832 | A1 * | 1/2002 | Katase | 345/107 |
| 2005/0001812 | A1 * | 1/2005 | Amundson et al. | 345/107 |
| 2005/0179641 | A1 * | 8/2005 | Zhou et al. | 345/107 |
| 2006/0066558 | A1 * | 3/2006 | Zhou et al. | 345/107 |
| 2006/0290650 | A1 * | 12/2006 | Johnson et al. | 345/107 |
| 2007/0139358 | A1 * | 6/2007 | Sakamoto | 345/107 |
| 2007/0296690 | A1 * | 12/2007 | Nagasaki | 345/107 |
| 2009/0040201 | A1 * | 2/2009 | Kim et al. | 345/204 |
| 2009/0046114 | A1 * | 2/2009 | Lee et al. | 345/691 |

FOREIGN PATENT DOCUMENTS

| | | |
|---|---|---|
| JP | 2010026159 | 2/2010 |
| KR | 1020080041356 | 5/2008 |
| KR | 1020080079383 | 9/2008 |
| KR | 1020090018270 | 2/2009 |
| KR | 1020120043246 A | 5/2012 |

* cited by examiner

*Primary Examiner* — Dorothy Harris
(74) *Attorney, Agent, or Firm* — Cantor Colburn LLP

(57) ABSTRACT

A method for driving an electrophoresis display device includes applying a reset voltage having a first polarity to electrophoresis material of the display device for at least one frame period to display a reset image, applying a first gradation voltage having a second polarity opposite to the first polarity to the electrophoresis material for one frame period to display a first grey image after the reset image is displayed, applying a second gradation voltage having the second polarity to the electrophoresis material corresponding to at least one pixel region of the display device for at least two frame periods to display a second grey image, after the first grey image is displayed; and applying a third gradation voltage having the first polarity to the electrophoresis material corresponding to at least one pixel region for one frame period to display a third grey image, after the second grey image is displayed.

19 Claims, 13 Drawing Sheets

METHOD FOR DRIVING ELECTROPHORESIS DISPLAY DEVICE

This application claims priority to Korean Patent Application No. 10-2011-0019553, filed on Mar. 4, 2011, and all the benefits accruing therefrom under 35 U.S.C. §119, the content of which in its entirety is hereby incorporated by reference.

BACKGROUND OF INVENTION

The disclosure herein relates to a method for driving an electrophoresis display device, and more particularly, to a method for driving an electrophoresis display device that clearly displays multiple steps of gradation.

Generally, a liquid crystal display ("LCD") displays an image using optical characteristics of liquid crystal, and is thinner than a cathode ray tube display device. However, since an LCD is provided with a backlight assembly for supplying light to liquid crystal, manufacturing thin and lightweight LCDs may be limited.

An electrophoresis display device displays an image using an electrophoresis phenomenon where electrically charged electrophoresis particles are moved due to an electric field generated between a pair of substrates. An electrophoresis display device is a reflection-type display device which displays an image by reflecting or absorbing light incident from the outside through the electrophoresis particles, and thus, an electrophoresis display device may display images without a light source. Therefore, an electrophoresis display device is typically thinner and lighter than an LCD.

BRIEF SUMMARY OF THE INVENTION

The disclosure provides a method for driving an electrophoresis display device capable of clearly displaying multiple steps of gradation.

Embodiments of the invention provide methods for driving an electrophoresis display device including: applying a reset voltage having a first polarity to a electrophoresis material of the display device for at least one frame period to display a reset image, applying a first gradation voltage having a second polarity opposite to the first polarity to the electrophoresis material for one frame period to display a first grey image, after the reset image is displayed, applying a second gradation voltage having the second polarity to the electrophoresis material corresponding to at least one pixel region of the display device for at least two frame periods to display a second grey image, after the first grey image is displayed; and applying a third gradation voltage having the first polarity to the electrophoresis material corresponding to at least one pixel region for one frame period to display a third grey image, after the second grey image is displayed, where the display device includes a first substrate including a plurality of pixel regions, a second substrate disposed opposite to the first substrate, and the electrophoresis material disposed between the first substrate and the second substrate and corresponding to each of the pixel regions.

In an exemplary embodiment, the second gradation voltage may be applied for k frame periods, where k is an even number greater than or equal to 2.

In an exemplary embodiment, the second grey image may be divided into a plurality of images having different gradations based on a time period during which the second gradation voltage is applied to the electrophoresis material corresponding to each of the pixel regions.

In an exemplary embodiment, the reset voltage may have a voltage level substantially the same as a voltage level of the first gradation voltage, a voltage level of the second gradation voltage and a voltage level of the third gradation voltage.

In an exemplary embodiment, the reset voltage may be applied for a time period obtained by adding the frame periods for which the first gradation voltage, the second gradation voltage and the third gradation voltage are applied, respectively.

In an exemplary embodiment, the method may further include applying a first reverse voltage having the second polarity to the electrophoresis material corresponding to at least one of the pixel regions to display a first reverse image having a gradation opposite to a gradation of the reset image, after the third grey image displayed.

In an exemplary embodiment, the method may further include applying a second reverse voltage having the first polarity to the electrophoresis material corresponding to at least one of the pixel regions to display a second reverse image having a gradation substantially the same as a gradation of the reset image, after the third grey image is displayed, and applying a third reverse voltage having the second polarity to the electrophoresis material to display a third reverse image having a gradation opposite to the gradation of the second reverse image, after the second reverse image is displayed.

In an exemplary embodiment, the electrophoresis material may include a plurality of first electrophoresis particles having a polarity, a plurality of second electrophoresis particles having a polarity opposite to the polarity of the first electrophoresis particles, and a dielectric solvent in which the first and second electrophoresis particles are dispersed.

In an exemplary embodiment, the electrophoresis display device may further include a separation wall a separation wall disposed between the first substrate and the second substrate, wherein the separation wall divides a space between the first substrate and the second substrate into a plurality of pixel spaces corresponding to the pixel regions.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION OF THE INVENTION

Figure 1:
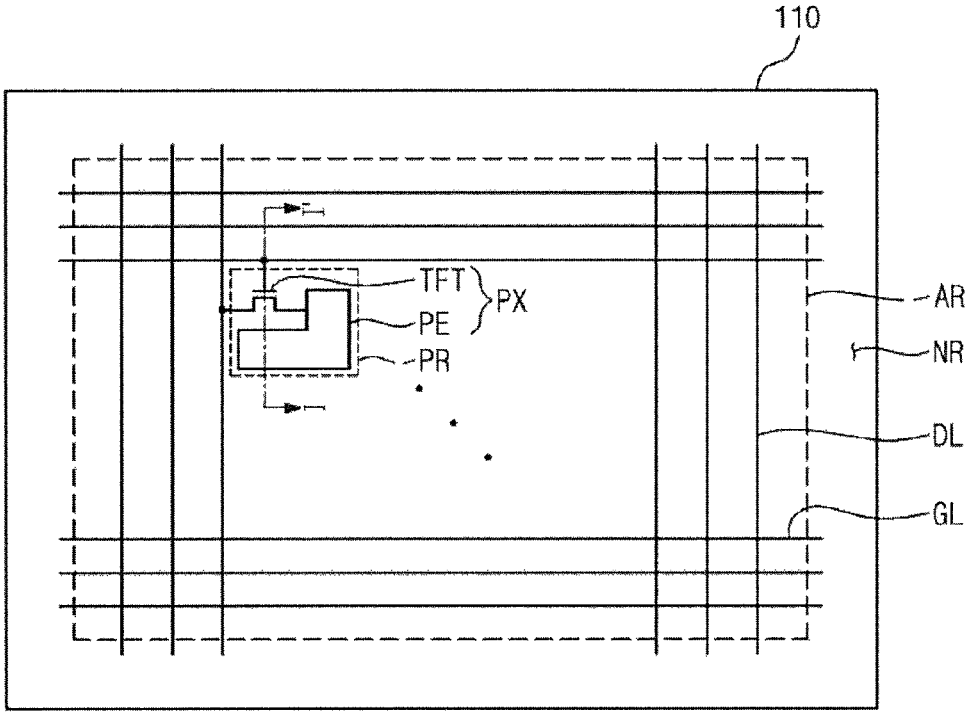
FIG. 1 is a plan view illustrating an exemplary embodiment of an electrophoresis display device according to the invention.

The invention now will be described more fully hereinafter with reference to the accompanying drawings. The invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a," "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

Figure 2:
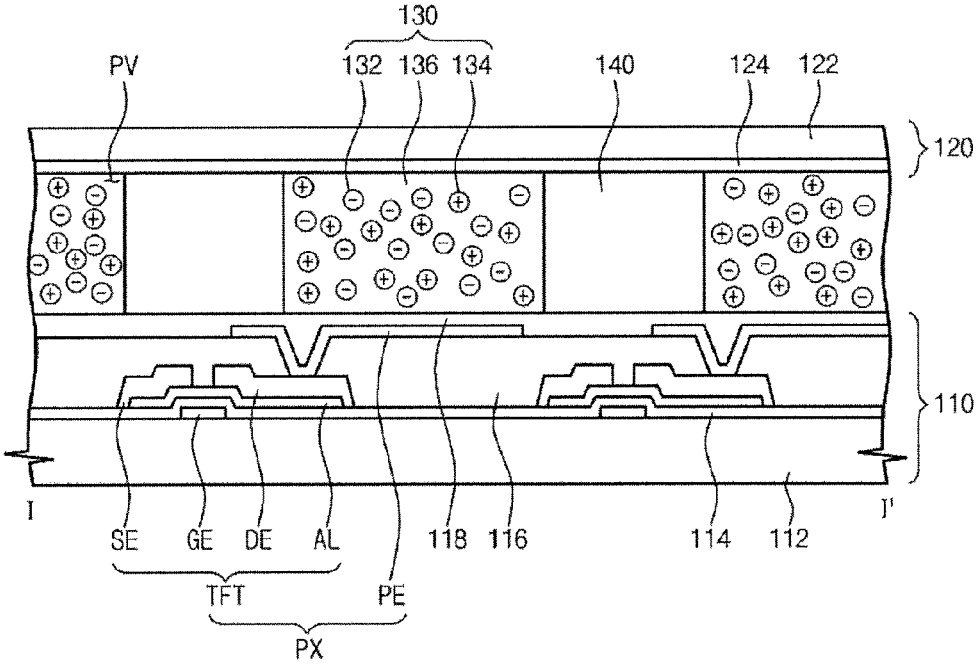
FIG. 2 is a cross-sectional view taken along line I-I' of the electrophoresis display device in FIG. 1.

FIG. 1 is a plan view of an exemplary embodiment of an electrophoresis display device according to the invention, FIG. 2 is a cross-sectional view taken along line I-I' of the electrophoresis display device in FIG. 1, and FIGS. 3A to 3D are cross-sectional views illustrating arrangement of electrophoresis materials included in the electrophoresis display device illustrated in FIGS. 1 and 2 in various states. In FIG. 1, an opposing substrate is omitted for convenience of description.

Referring to FIGS. 1 and 2, the electrophoresis display device includes a first substrate 112, on which a plurality of pixel regions PR is defined, and a second substrate 122 disposed opposite to, e.g., facing, the first substrate 112. The electrophoresis display device also includes an electrophoresis material 130, which corresponds to each of the pixel regions PR, between the first substrate 112 and the second substrate 122.

The first substrate 112 includes a display region AR and a non-display region NR. The display region AR is provided with a plurality of pixels PX corresponding to the pixel regions PR, and an image is displayed on the display region AR. The non-display region NR is disposed around the display region AR. In an exemplary embodiment, the non-display region NR is disposed surrounding the display region AR. In an exemplary embodiment, embodiment, the first substrate 112 includes a transparent member such as a glass substrate, a plastic substrate and a silicon substrate, for example.

The first substrate 112 includes a plurality of gate lines GL disposed thereon and a plurality of data lines DL crossing the gate lines GL. In an exemplary embodiment, the first substrate 112 including the gate lines GL, the data lines GL and the pixels PX defines the array substrate 110.

Since each of the pixels PX has a same structures and same functions, a single pixel will be described in detail for convenience of description, and the same elements in the pixels will be referred to as the same reference characters. Each of the pixels PX includes a thin film transistor ("TFT"), which switches a pixel voltage corresponding to an image, and a pixel electrode PE (or first electrode) electrically connected to the TFT.

As illustrated in FIG. 2, the TFT includes a gate electrode GE, an active layer AL, a source electrode SE and a drain electrode DE. The gate electrode GE extends from a corresponding gate line of the gate lines GL on the first substrate 112. A gate dielectric 114, which covers the gate lines GL and the gate electrode GE extending from the corresponding gate line, is disposed on the first substrate 112. An active layer AL is disposed on the gate dielectric 114, and the source electrode SE and the drain electrode DE are disposed on the active layer AL. The source electrode SE and the drain electrode DE are separated from each other to expose the active layer AL. The data lines DL are disposed on the gate dielectric 114, and the source electrode SE extends from a corresponding data line of the data lines DL.

A protective layer 116 including an insulation layer is disposed on the gate dielectric 114 covering the source electrode SE, the drain electrode DE and the exposed active layer AL. The pixel electrode PE, electrically connected to the drain electrode DE through a contact hole, is disposed on the protective layer 116 in each pixel PX.

In an exemplary embodiment, an over coat layer 118, which covers the pixel electrode PE and provides a planar surface, is disposed on the protective layer 116. The over coat layer 118 may include an insulation layer or a color filter. In such an embodiment, the over coat layer 118 may include a color filter pattern of red, green or blue corresponding to the pixel region.

The second substrate 122 is disposed on the first substrate 112. The second substrate 122 facing the first substrate 112 may include a material substantially the same as a material of the first substrate 112. A common electrode 124 (or second electrode) is provided on an opposing surface of the second substrate 122, which faces the first substrate 112. The common electrode 124 may be provided covering an entire opposing surface of the second substrate 122. The second substrate 122 provided with the common electrode 124 is defined as an opposing substrate 120. In an exemplary embodiment, in which the over coat layer 118 includes an insulation layer, the second substrate 122 may further include a color filter disposed facing the first substrate 112.

The electrophoresis material 130 is disposed between the first substrate 112 and the second substrate 122. In one exemplary embodiment, for example, the electrophoresis material 130 is provided in a form of a micro capsule in each pixel region PR. The electrophoresis material 130 may include a dielectric solvent 136 and a plurality of electrophoresis particles dispersed in the dielectric solvent 136. The electrophoresis particles may have predetermined colors.

In an exemplary embodiment, the electrophoresis particles may include a plurality of first electrophoresis particles 132 having a polarity, and a plurality of second electrophoresis particles 134 having a polarity opposite to the polarity of the first electrophoresis particles 132. The first electrophoresis particles 132 and the second electrophoresis particles 134 may have predetermined colors. In one exemplary embodiment, for example, the first electrophoresis particles 132 may have a negative polarity and a white color, and the second electrophoresis particles 134 may have a positive polarity and a black color. In an alternative exemplary embodiment, polarities or colors of the first electrophoresis particles 132 and the second electrophoresis particles 134 may be changed.

In an exemplary embodiment, a separation wall 140 may be further included between the first substrate 112 and the second substrate 122. The separation wall 140 divides a plurality of pixel spaces PV such that each of the pixel spaces corresponds to one pixel region PR. In such an embodiment, the electrophoresis material 130 may fill each of the pixel spaces PV.

The electrophoresis display device displays a different image based on arrangements of the first and second electrophoresis particles 132 and 134. In an exemplary embodiment, the electrophoresis display device may display an image having a different gradation. The arrangements of the first and second electrophoresis particles 132 and 134 is affected by a level, a polarity or applying time of a driving voltage applied to the electrophoresis material 130, and the arrangements of the first and second electrophoresis particles 132 and 134 will be described in greater detail referring to FIGS. 3A to 3D. Hereinafter, applying the driving voltage to the electrophoresis material 130 means that the pixel voltage and the common voltage are respectively applied to the pixel electrode PE and the common electrode 124, and the electrophoresis material 130 is affected by an electric field generated due to a potential difference between the common voltage and the pixel voltage.

In an exemplary embodiment, polarities of driving voltages applied to the electrophoresis material 130 may be determined with respect to a value obtained by subtracting the pixel voltage from the common voltage.

In FIGS. 3A to 3D, an exemplary embodiment of the electrophoresis material 130 includes the first electrophoresis particles 132 having a negative polarity and a white color, and the second electrophoresis particles 134 having a positive polarity and a black color, but not being limited thereto.

Figure 3A:
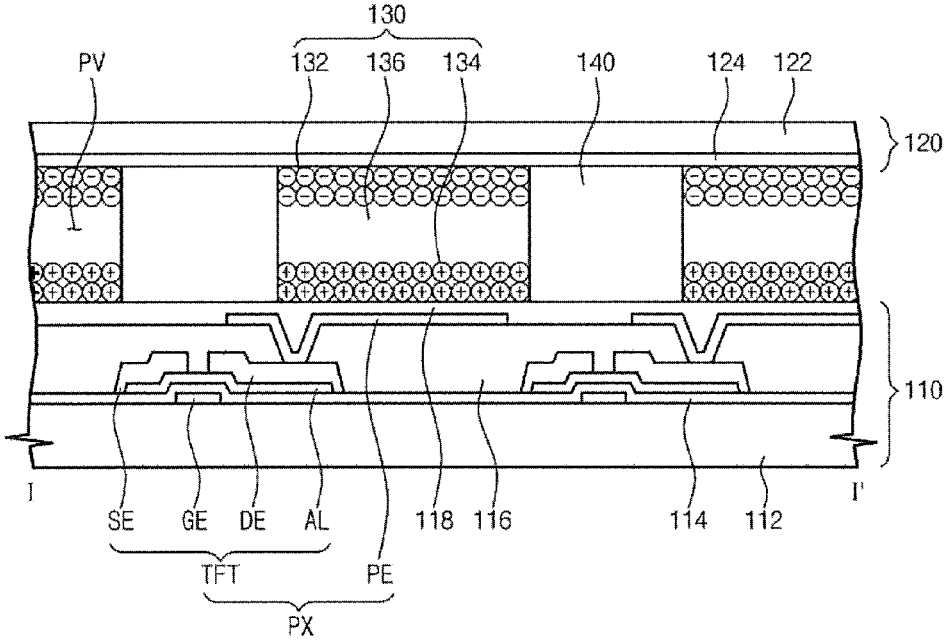
FIGS. 3A to 3D are cross-sectional views illustrating arrangement of electrophoresis materials included in the electrophoresis display device illustrated in FIGS. 1 and 2 in various states.

Firstly, referring to FIG. 3A, a driving voltage of positive polarity is applied to the electrophoresis material 130, and thus, the first electrophoresis particles 132 included in the electrophoresis material 130 corresponding to each pixel region PR are arranged near the common electrode 124, and the second electrophoresis particles 134 are arranged near the pixel electrode PE. When the electrophoresis particles are arranged as shown in FIG. 3A, most of external light incident to each pixel region PR from outside is reflected by the first electrophoresis particles 132 having the white color. Accordingly, each pixel region PR may display a white image. In an alternative exemplary embodiment, in which first electrophoresis particles 132 has the black color and the second electrophoresis particles 134 has the white color, a black image is displayed.

Figure 3B:
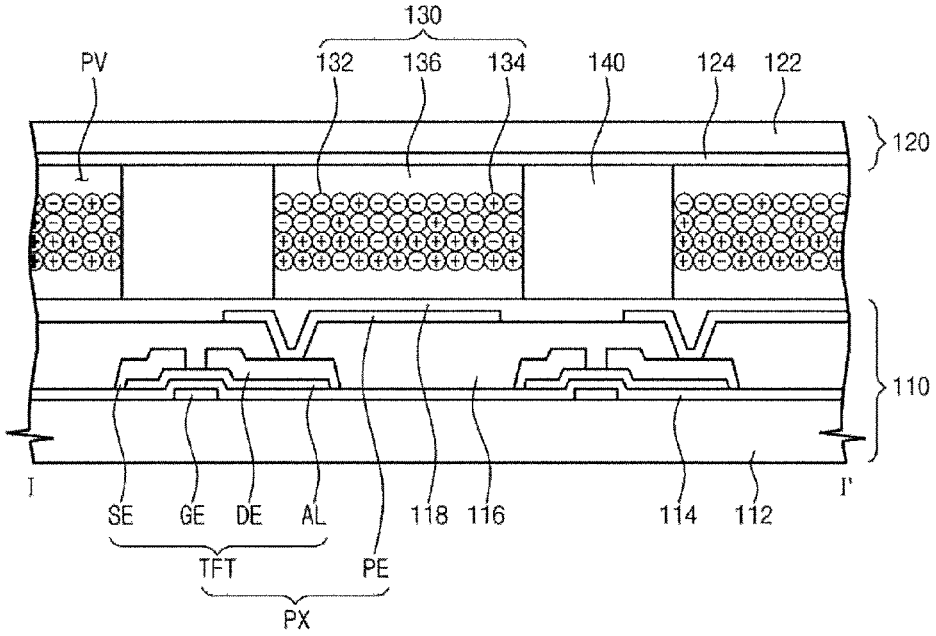
Figure 3C:
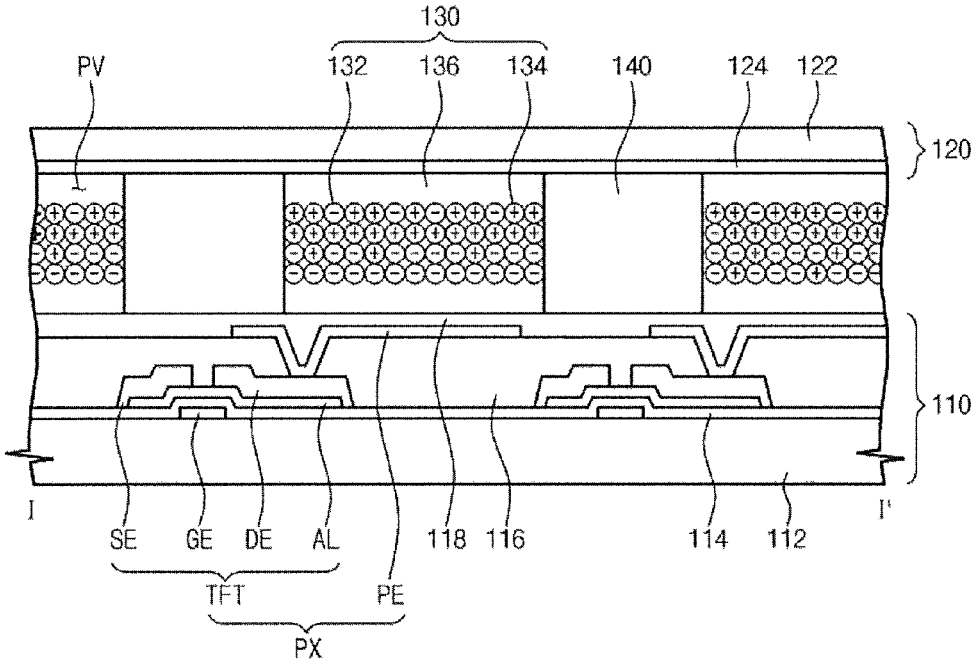

As illustrated in FIGS. 3B and 3C, when a driving voltage of negative polarity is applied to the electrophoresis material 130 after the electrophoresis display device displays the white image, the first and second electrophoresis particles 132 and 134 in each pixel region PR are arranged between the common electrode 124 and the pixel electrode PE. Portions of the first electrophoresis particles 132 are moved toward the pixel electrode PE, and portions of the second electrophoresis particles 134 are moved toward the common electrode 124. In such an embodiment, a part of the external light incident to each pixel region PR from the outside is reflected by the first electrophoresis particles 132 having the white color, and another part is absorbed by the second electrophoresis particles 134 having the black color, and thus, a grey image is displayed.

In such an embodiment, a grey image of different gradation is displayed based on a level and a time period during which the driving voltage of negative polarity is applied. In one exemplary embodiment, for example, since a time period during which the driving voltage of negative polarity is applied to the electrophoresis material 130 in the electrophoresis display device illustrated in FIG. 3C is longer than a time period during which the driving voltage of negative polarity is applied to the electrophoresis material 130 in the electrophoresis display device illustrated in FIG. 3D, the first electrophoresis particles 132 and the second electrophoresis particles 134 are further moved toward the pixel electrode PE and the common electrode 124, thereby displaying a grey image of high gradation (close to a black image).

Figure 3D:
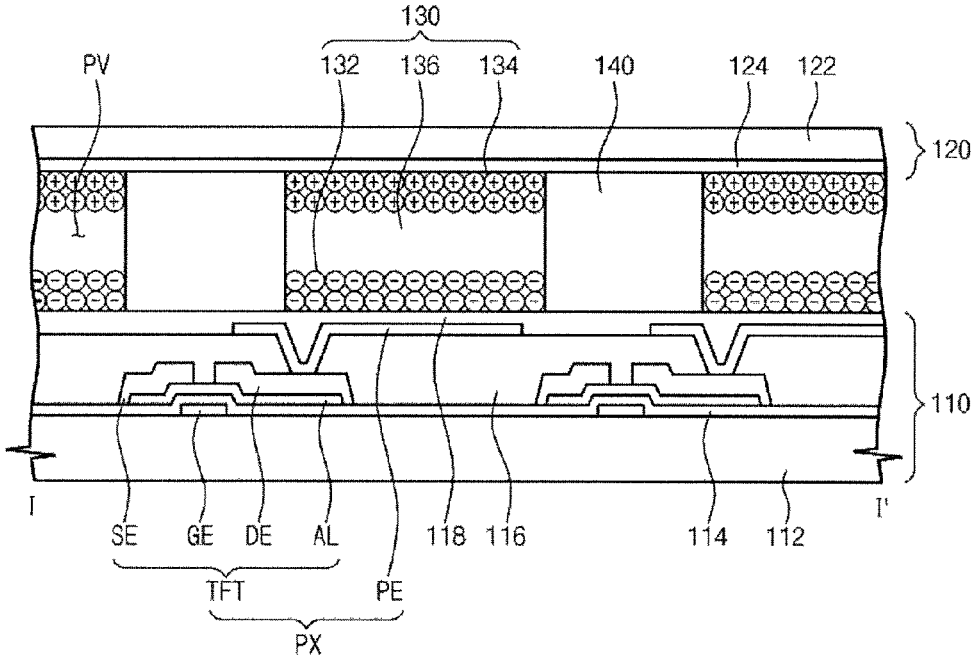

In an exemplary embodiment, when the driving voltage of negative polarity is applied to the electrophoresis material 130 during a time period longer time than a certain time, the first electrophoresis particles 132 corresponding to each pixel region PR are arranged closer to the pixel electrode PE, and the second electrophoresis particles 134 are arranged closer to the common electrode 124 as illustrated in FIG. 3D. When the electrophoresis particles are in the arrangement as shown in FIG. 3D, most of the external light incident to each pixel region PR from the outside is absorbed by the black second electrophoresis particles 134. Accordingly, the electrophoresis display device displays a black image.

Performance of the electrophoresis display device is determined according to how many steps of gradation may be displayed and according to whether each gradation is clearly displayed. That is, the performance of the electrophoresis display device is determined according to how many steps of the grey image described above referring to FIGS. 3B and 3C are displayed and according to whether the grey image of each step is clearly displayed.

Figure 4:
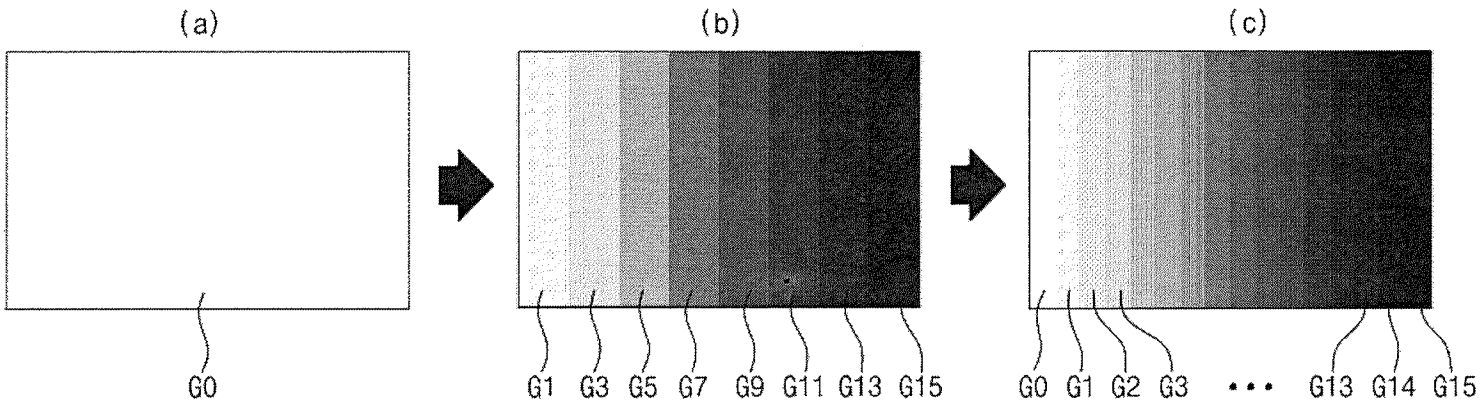
FIG. 4 is a diagram illustrating a change of gradations of an image changed using an exemplary embodiment of a method for driving the electrophoresis display device according to the invention.
Figure 5:
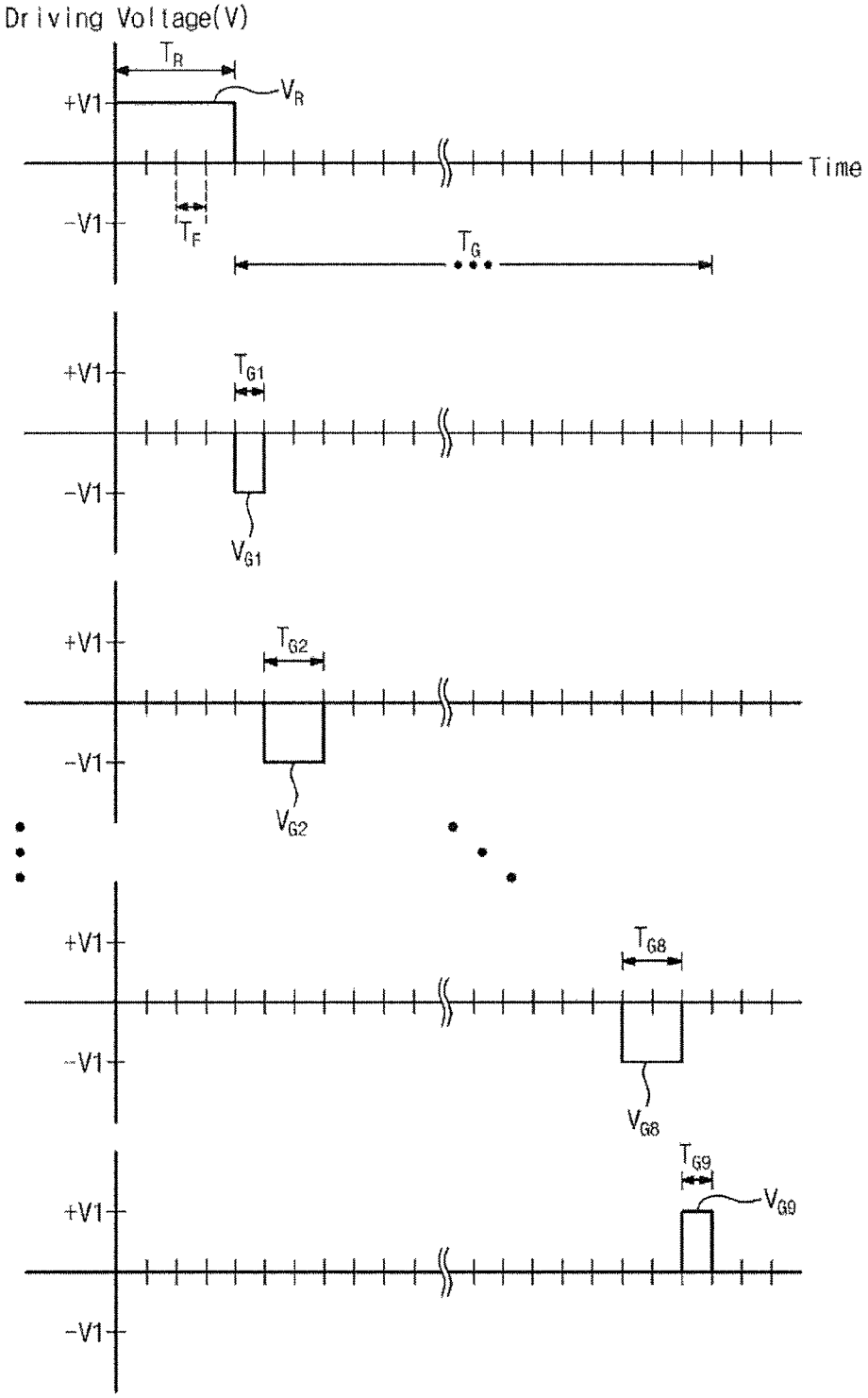
FIG. 5 is a diagram illustrating a change of a driving voltage applied to the electrophoresis material with respect to time in an exemplary embodiment of a method for driving the electrophoresis display device according to the invention.

Hereinafter, an exemplary embodiment of a method for driving the electrophoresis display device according to the invention will now be described referring to FIGS. 4 and 5. FIG. 4 is a diagram illustrating a gradation of an image changed using an exemplary embodiment of the method for driving the electrophoresis display device according to the invention, and FIG. 5 is a diagram illustrating a change of a driving voltage applied to the electrophoresis material with respect to time. FIGS. 4 and 5 illustrate an exemplary embodiment of the method for driving the electrophoresis display device which displays 16 steps of gradation.

In such an embodiment, the driving method is described based on the exemplary embodiment of the electrophoresis display device illustrated in FIGS. 3A to 3D for convenience of description. In such an embodiment of the electrophoresis display device, the driving voltage is applied to the electrophoresis material corresponding to each pixel region at each frame period to display an image having predetermined information. In one exemplary embodiment, for example, when the electrophoresis display device is operated at 50 hertz (Hz), one frame period is about 0.02 seconds, and the driving voltage is applied to the electrophoresis material corresponding to each pixel region 50 times for one second.

According to an exemplary embodiment of the method for driving the electrophoresis display device, firstly, a reset voltage $V_R$ is applied to the electrophoresis material 130 for a reset period $T_R$ to thereby display a reset image as illustrated in FIG. 5. In an exemplary embodiment, the reset voltage $V_R$ is applied to the electrophoresis material 130 for at least one frame period $T_F$. The reset period $T_R$, during which the reset voltage $V_R$ is applied, may be changed based on a gradation of an image displayed before the reset voltage $V_R$ is applied. In an exemplary embodiment of the electrophoresis display device illustrated in FIG. 3A, the reset voltage $V_R$ may be a driving voltage +V1 of positive polarity, as illustrated in FIG. 5. When the reset voltage $V_R$ is applied to the electrophoresis display device, the electrophoresis display device may display a reset image as illustrated in FIG. 4(*a*). The reset image is a white image as illustrated in FIG. 4(*a*). In an exemplary embodiment, the gradation of image may be divided into 16 steps from a white image to a black image, where the white image represents a $0^{th}$ step of gradation G0 and the black image represents a $15^{th}$ step of gradation G15.

After the reset image is displayed on the electrophoresis display device, gradation voltages $V_{G1}$ to $V_{G9}$ are applied to the electrophoresis material 130 for a grey period $T_G$. The gradation voltage $V_{G1}$ to $V_{G9}$ may include a first gradation voltage $V_{G1}$, second gradation voltages $V_{G2}$ to $V_{G8}$, and a third gradation voltages $V_{G9}$. The first gradation voltage having a second polarity, opposite to the first polarity of the reset voltage $V_R$, is applied to the electrophoresis material 130 for a predetermined time period $T_{G1}$ to thereby display a first grey image. In an exemplary embodiment, the first gradation voltage is applied to the electrophoresis material 130 for one frame period $T_F$. As illustrated in FIG. 5, the first gradation voltage may be a driving voltage −V1 of negative polarity. The first grey image has a first step of gradation G1.

After the first grey image is displayed on the electrophoresis display device, the second gradation voltages $V_{G2}$ to $V_{G8}$ having the same polarity as the first gradation voltage are applied to the electrophoresis material 130 corresponding to at least one pixel region PR for a predetermined time period $T_{G2}$ to $T_{G8}$ to thereby display a second grey image. In an exemplary embodiment, one of the second gradation voltages $V_{G2}$ to $V_{G8}$ is applied for at least two frame periods $T_F$. As illustrated in FIG. 5, the second gradation voltages $V_{G2}$ to $V_{G8}$ are also a driving voltage −V1 of negative polarity.

When the second gradation voltages $V_{G2}$ to $V_{G8}$ are applied to the electrophoresis material 130 corresponding to a portion of the pixel regions PR, the first grey image illustrated in FIG. 4(*a*) is divided into images having multiple steps of gradation since degrees of reflecting and absorbing the external light are different from each other in the electrophoresis material corresponding to each pixel region. As a result, a second grey image has a greater number of steps of gradation than the first grey image.

In one exemplary embodiment, for example, as illustrated in FIG. 4(*b*), the first grey image may be divided into images having 8 different steps of gradation, e.g., G1, G3 to G13, and G15. In such an embodiment, when images having a relatively high step of gradation are displayed, the second gradation voltages $V_{G2}$ to $V_{G8}$ may be applied to the electrophoresis material during a relatively long time period.

In an exemplary embodiment, when the second gradation voltages $V_{G2}$ to $V_{G8}$ are applied during k frame periods (k is an even number greater than or equal to 2), a difference of gradation may be constant on the images having different steps of gradation. As illustrated in FIG. 4, the second gradation voltages $V_{G2}$ to $V_{G8}$ are not applied to the electrophoresis material 130 included in the pixel region PR which displays an image having the first step of gradation G1, and the one of the second gradation voltages $V_{G2}$ to $V_{G8}$ is applied to the electrophoresis material 130 included in the pixel region PR which displays an image having the third step of gradation G3 for two frame periods (e.g., a time period $T_{G2}$ illustrated in FIG. 5). Also, the second gradation voltages $V_{G2}$ to $V_{G8}$ are applied to the electrophoresis material 130 included in the pixel region PR which displays the fifteenth step of gradation G15 for 14 frame periods (e.g., the time period from $T_{G2}$ to $T_{G8}$ illustrated in FIG. 5).

After the second grey image is displayed on the electrophoresis display device, the third gradation voltage $V_{G9}$ having the first polarity, opposite to the second polarity of the first gradation voltage $V_{G1}$, is applied to the electrophoresis material 130 corresponding to at least one pixel region PR for a predetermined time period $T_{G9}$ to thereby display a third grey image. In an exemplary embodiment, the third gradation voltage $V_{G9}$ is applied for one frame period $T_F$. As illustrated in FIG. 5, a third gradation voltage $V_{G9}$ may be a driving voltage +V1 of positive polarity.

When the third gradation voltage $V_{G9}$ is applied to the electrophoresis material 130 corresponding to a portion of the pixel regions PR, the second grey image illustrated in FIG. 4(*b*) is divided into images having a greater number of gradations. In one exemplary embodiment, for example, as illustrated in FIG. 4(*c*), the second grey image may be divided into images having 16 different steps of gradation (G0 to G16). Therefore, a third grey image has a greater number of steps of gradation than the second grey image.

More detailed description will be given referring to FIGS. 3B, 3C, 4(*b*), 4(*c*) and 5. Firstly, when the image having the third step of gradation G3 illustrated in FIG. 4(*b*) is displayed on the pixel region PR provided with the electrophoresis materials 130 arranged as illustrated in FIG. 3C, the third gradation voltage $V_{G9}$ having a polarity opposite to the polarity of the second gradation voltage is applied to the electrophoresis material 130 arranged as illustrated in FIG. 3C, and the first and second electrophoresis particles 132 and 134 are moved by an electric field generated by the third gradation voltage, and thereby arranged as illustrated in FIG. 3B. Accordingly, the white first electrophoresis particles 132 are moved closer to the common electrode 124, and reflectivity for the incident light is thereby increased. In such an embodiment, an image representing the third step of gradation G3 in FIG. 4(*b*) may be divided into an image representing the second step of gradation G2 and an image representing the third step of gradation G3, as illustrated in FIG. 4(*c*), by applying the third gradation voltage $V_{G9}$ to a portion of the pixel regions PR provided with the electrophoresis material 130 arranged as illustrated in FIG. 3C.

After the third grey image is displayed the predetermined time period $T_{G9}$, the electrophoresis display device may repeat the above-described processes such as applying the reset voltage and applying the gradation voltages to thereby provide various images to a user.

In an exemplary embodiment, for uniformly controlling movement of the first and second electrophoresis particles 132 and 134 with respect to the time periods during which the driving voltage is applied, the reset voltage $V_R$ may have a voltage level V1 substantially the same as the voltage level of the first to third gradation voltages.

In an exemplary embodiment, the reset voltage $V_R$ is applied during a reset period $T_R$ (see FIG. 5) obtained by adding the time periods during which the first to third gradation voltages are applied, such that an afterimage phenomenon is effectively prevented when the third grey image is changed to another third grey image. That is, the reset period $T_R$ is substantially same as the grey period $T_G$.

According to an exemplary embodiment of the method for driving the electrophoresis display device, multiple steps of gradation is more clearly displayed compared to a method where the gradation voltage is selectively applied to the electrophoresis material 130 corresponding to the at least partial pixel region during 15 frame periods to display an image having 16 steps of gradation.

Figure 6:
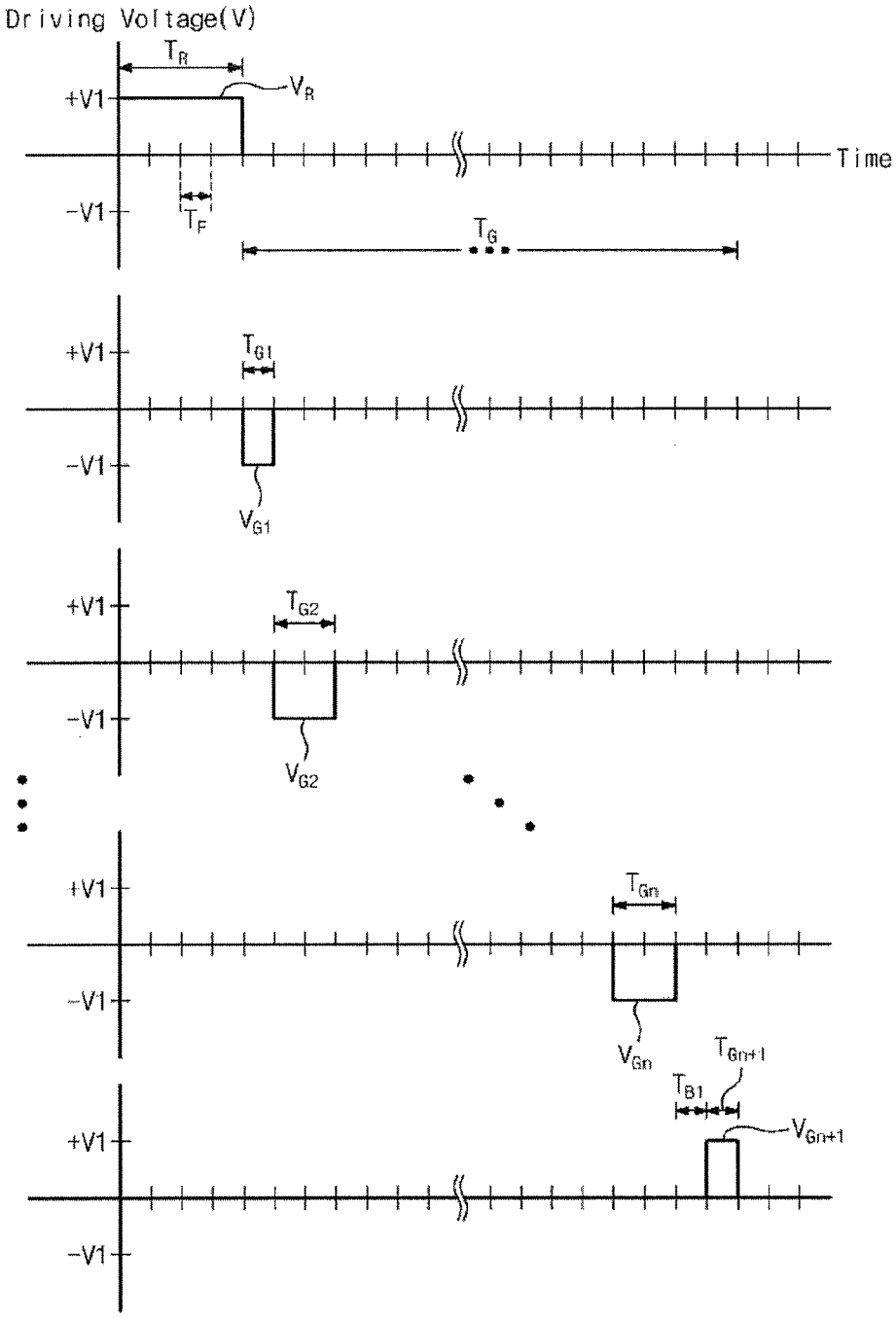
FIG. 6 is a diagram illustrating a change of a driving voltage applied to the electrophoresis material with respect to time in an alternative exemplary embodiment of a method for driving the electrophoresis display device according to the invention.

FIG. 6 is a diagram illustrating a change of a driving voltage applied to the electrophoresis material with respect to time in an alternative exemplary embodiment of a method for driving the electrophoresis display device according to the invention. Referring to FIG. 6, an alternative exemplary embodiment of the method for driving the electrophoresis display device according to the invention will now be described. However, any repetitive detailed description thereof will hereinafter be omitted.

In an exemplary embodiment as illustrated in FIG. 6, after the second grey image is displayed, the third gradation voltage $V_{Gn+1}$ is applied to the electrophoresis material 130 after a first blank period $T_{B1}$ during which a voltage is not applied to the electrophoresis material 130. The third gradation voltage $V_{Gn+1}$ is applied to the electrophoresis material 130 for a predetermined time period $T_{Gn+1}$. In an exemplary embodiment, the third gradation voltage $V_{Gn+1}$ is applied to the electrophoresis material 130 for one frame period $T_F$. In such an embodiment, the third gradation voltage may be applied to the electrophoresis material 130 corresponding to a portion of the pixel regions PR.

The first blank period $T_{B1}$ provides an additional movement time for the first and second electrophoresis particles 132 and 134 to form an arrangement by an electric field generated by the second gradation voltage. Therefore, the second grey image has a substantially clear gradation.

Figure 7:
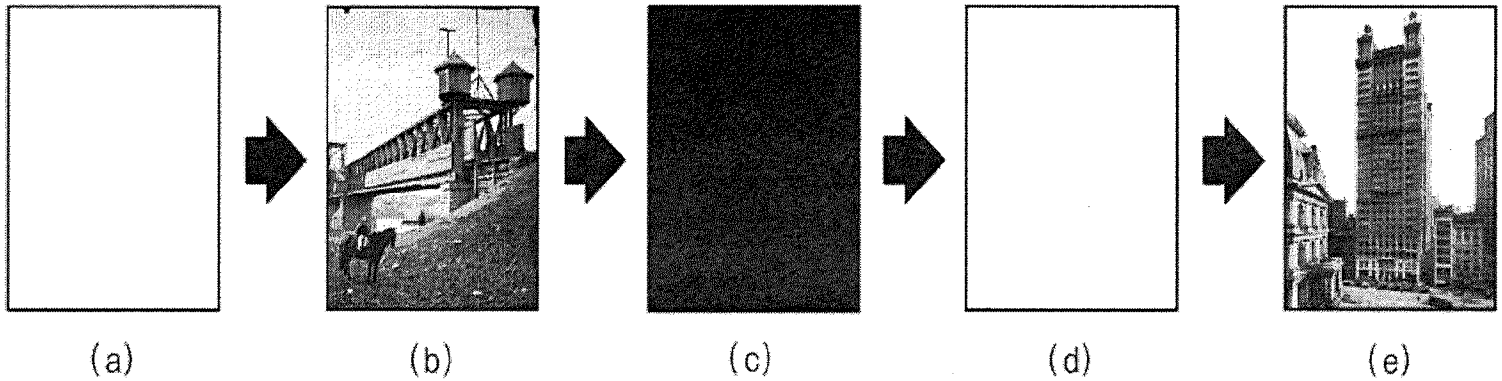
FIG. 7 is a diagram illustrating an image switching process in another alternative exemplary embodiment of a method for driving the electrophoresis display device according to the invention.
Figure 8:
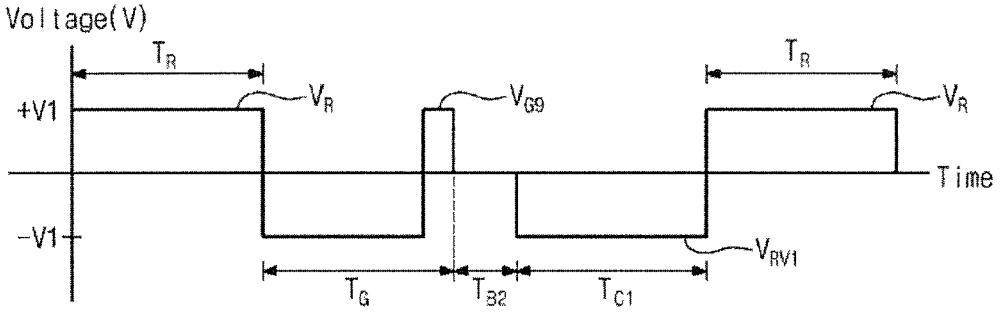
FIG. 8 is a diagram illustrating a change of a driving voltage with respect to time in the image switching process illustrated in FIG. 7.

FIG. 7 is a diagram illustrating an image switching process in another alternative exemplary embodiment of a method for driving the electrophoresis display device according to the invention, and FIG. 8 is a diagram illustrating a change of a driving voltage with respect to time in an exemplary embodiment of the image switching process illustrated in FIG. 7. Referring to FIGS. 7 and 8, an exemplary embodiment of the method for driving the electrophoresis display device according to the invention will now be described. However, any repetitive detailed description thereof will hereinafter be omitted.

In an exemplary embodiment, as illustrated in FIG. 8, after the reset voltage $V_R$ is applied during the reset period $T_R$, the gradation voltages having a polarity opposite to the polarity of the reset voltage $V_R$ is applied for the grey period $T_G$. As illustrated in FIG. 7, after the reset image is displayed, e.g., the image of FIG. 7(*a*), a third grey image is displayed, e.g., the image of FIG. 7(*b*). As illustrated in FIG. 8, after the third gradation voltage $V_{G9}$ is applied during a portion of the grey period $T_G$, a first reverse voltage $V_{RV1}$ having a polarity opposite to the polarity of the reset voltage $V_R$ is applied for a first reverse period $T_{C1}$. After the third grey image is displayed, a first reverse image is displayed, e.g., the image of FIG. 7(*c*).

As illustrated in FIG. 8, after the first reverse voltage $V_{RV1}$ is applied for the first reverse period $T_{C1}$, the reset voltage $V_R$ is applied during the reset period $T_R$. After the first reverse image is displayed, the reset image is displayed, e.g., the image of FIG. 7(*d*). After the reset image is displayed, another third grey image is displayed, e.g., the image of FIG. 7(*e*). In such an embodiment, as illustrated in FIG. 7, an afterimage is effectively prevented when one third grey image having predetermined information, e.g., the image of FIG. 7(*b*), is changed to another third grey image having different information, e.g., the image of FIG. 7(*e*).

When the first reverse voltage $V_{RV1}$ is applied, a first reverse image is displayed. In such an embodiment, since a polarity of the first reverse voltage $V_{RV1}$ is opposite to the polarity of the reset voltage $V_R$, the first reverse image is a black image as illustrated in FIG. 7(*c*) where the reset image is white as illustrated in FIG. 4(*a*) and FIG. 7(*d*). In an exemplary embodiment, the first reverse voltage $V_{RV1}$ is applied to the electrophoresis material 130 corresponding to each pixel region PR, which does not display the fifteenth step of gradation G15 (see FIG. 4) among the pixel regions PR, and the first reverse image is thereby displayed.

When the first reverse image is displayed on the electrophoresis display device, a reset voltage $V_R$ is applied again, and the above-described gradation voltages are applied to thereby display another third grey image having the different information.

In such an embodiment, for uniformly controlling movement of the first and second electrophoresis particles 132 and 134 with respect to the time period, during which the driving voltages are applied, the first reverse voltage has a voltage level V1 substantially the same as the voltage level of the first to third gradation voltages.

In such an embodiment, the first reverse voltage $V_{RV1}$ is applied during the grey period $T_G$ obtained by adding the time periods during which the first to third gradation voltages are applied. In an exemplary embodiment, the first reverse period $T_{C1}$ and the grey period $T_G$ illustrated in FIG. 8 may be substantially equal to each other.

In such an embodiment, after the third grey image is displayed, the first reverse voltage $V_{RV1}$ is applied after a second blank period $T_{B2}$ during which a voltage is not applied to the electrophoresis material. The second blank time $T_{B2}$ provides an additional movement time for the first and second electrophoresis particles 132 and 134 to be in an arrangement for displaying the black image.

Figure 9:
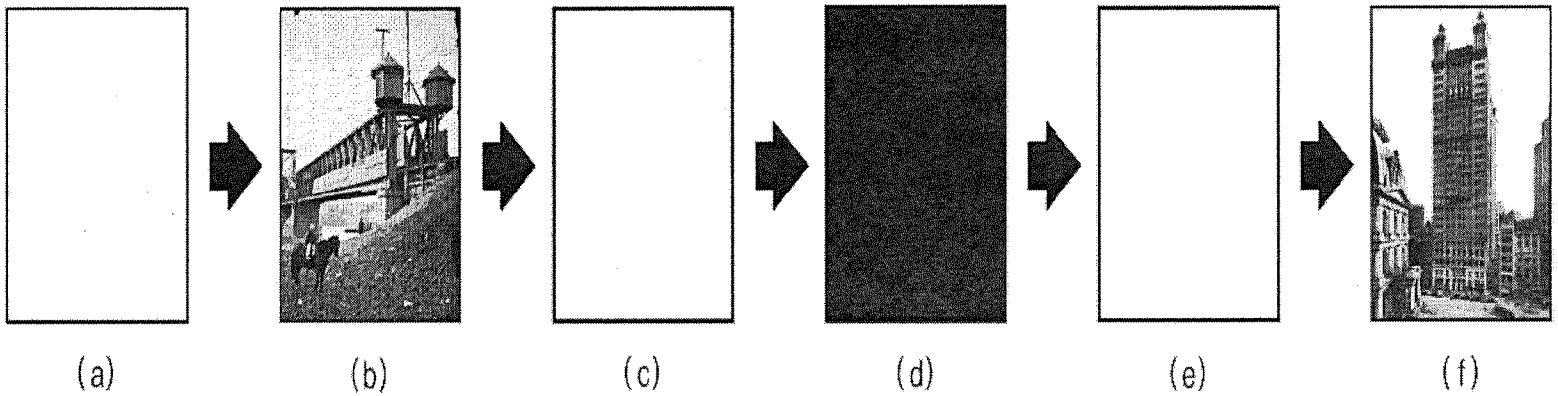
FIG. 9 is a diagram illustrating an image switching process in still another alternative exemplary embodiment a method for driving the electrophoresis display device according to the invention.
Figure 10:
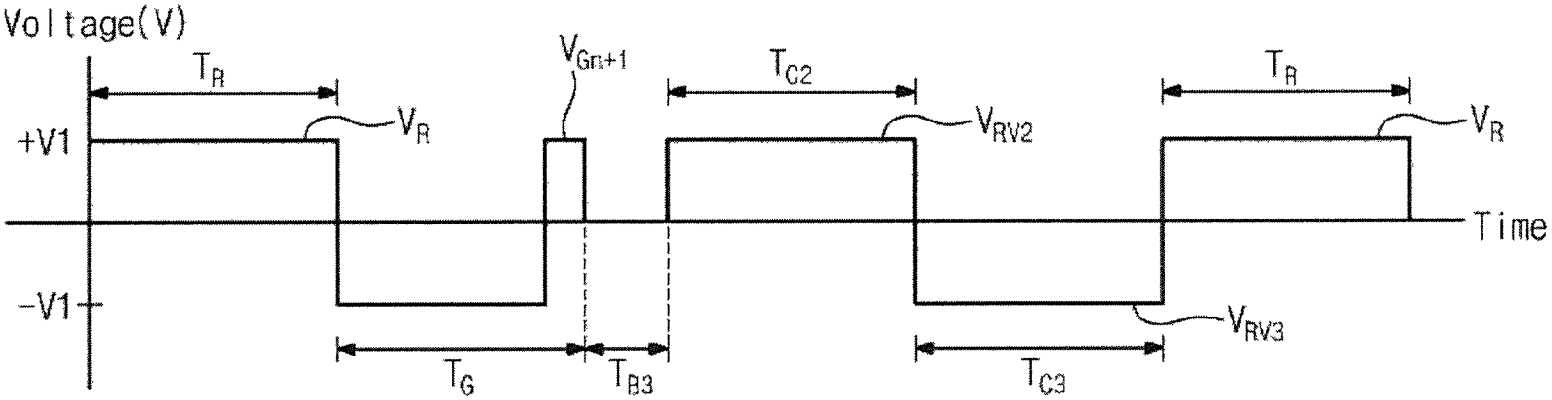
FIG. 10 is a diagram illustrating a change of a driving voltage with respect to time in the image switching process illustrated in FIG. 9.

FIG. 9 is a diagram illustrating the image switching process of an alternative exemplary embodiment of a method for driving the electrophoresis display device according to the invention, and FIG. 10 is a diagram illustrating a change of a driving voltage with respect to time in the image switching process illustrated in FIG. 9. Referring to FIGS. 9 and 10, an alternative exemplary embodiment of the method for driving the electrophoresis display device according to the invention will now be described. However, any repetitive detailed description thereof will hereinafter be omitted.

In an exemplary embodiment, as illustrated in FIG. 10, after the third gradation voltage $V_{Gn+1}$ is applied to display the image of FIG. 9(*b*), a first reverse voltage $V_{RV2}$ having a polarity the same as the polarity of the reset voltage $V_R$ is applied during a first reverse period $T_{C2}$, and a second reverse voltage $V_{RV3}$ having a polarity opposite to the polarity of the reset voltage $V_R$ is applied during a second period $T_{C3}$. As illustrated in FIG. 9, after the third grey image is displayed, a first reverse image is displayed, e.g., the image of FIG. 9(*c*) and a second reverse image is displayed, e.g., the image of FIG. 9(*d*), sequentially. Accordingly, as illustrated in FIG. 9, an afterimage is effectively prevented when one third grey image having predetermined information, e.g., the image of FIG. 9(*b*), is changed to another third grey image having different information, e.g., the image of FIG. 9(*f*).

In an exemplary embodiment, when the first reverse voltage $V_{RV2}$ is applied, the first reverse image is displayed. In such an embodiment, since the polarity of the first reverse voltage $V_{RV2}$ is the same as the polarity of the reset voltage $V_R$, the first reverse image is also a white image, as illustrated in FIG. 9(*c*) when the reset image is a white image, as illustrated in FIG. 9(*a*). In such an embodiment, when the second reverse voltage $V_{RV3}$ is applied, a second reverse image of black color is displayed as illustrated in FIG. 9(*b*). The first reverse voltage is applied to the electrophoresis material 130 corresponding to each pixel region PR which does not display $0^{th}$ step of gradation G0 among the pixel regions PR. In such an embodiment, after the first reverse image is displayed, the second reverse voltage is applied to the electrophoresis material 130 corresponding to each pixel region PR.

When the second reverse image is displayed on the electrophoresis display device, a reset voltage $V_R$ is applied again, and the above-described gradation voltages are applied to thereby display another third grey image having the different information.

In an exemplary embodiment, for uniformly controlling movement of the first and second electrophoresis particles 132 and 134 with respect to the time periods during which the driving voltages are applied, the first reverse voltage $V_{RV2}$ may have a voltage level V1 substantially the same as the voltage level of the first to third gradation voltages, and the second reverse voltage $V_{RV3}$ may have a voltage level substantially the same as the voltage level of the first reverse voltage $V_{RV2}$.

In an exemplary embodiment, the first reverse voltage $V_{RV2}$ is applied during a grey period $T_G$ obtained by adding the time periods during which the first to third gradation voltages are applied. In an exemplary embodiment, the first reverse period $T_{C2}$ and the grey period $T_G$ illustrated in FIG. 10 may be equal to each other. Also, the second reverse voltage $V_{RV3}$ is applied for the second reverse period $T_{C2}$ during which the second reverse voltage $V_{RV3}$ is applied. Therefore, the second reverse period $T_{C3}$ and the first reverse period $T_{C2}$ illustrated in FIG. 10 are equal to each other.

After the third grey image is displayed, the first reverse voltage $V_{RV2}$ is applied after a third blank period $T_{B3}$ during which a voltage is not applied to the electrophoresis material. The third blank time $T_{B3}$ provides an additional movement time for the first and second electrophoresis particles 132 and 134 to be in an arrangement for displaying the white image. In such an embodiment, after the first reverse image is displayed, the second reverse voltage $V_{RV3}$ may be applied after another blank period, during which a voltage is not applied to the electrophoresis material.

As described above, multiple steps of gradation are substantially clearly displayed using an exemplary embodiment of the method for driving an electrophoresis display device. In an exemplary embodiment, multiple steps of gradation are substantially clearly displayed without increasing the time frame and the driving voltage.

According to an exemplary embodiment of the method for driving an electrophoresis display device, an afterimage phenomenon is effectively prevented by displaying a reverse image having a gradation substantially the same as a gradation of a reset image or having a reversed image when an image is changed.

The above-disclosed subject matter is to be considered illustrative and not restrictive, and the appended claims are intended to cover all such modifications, enhancements, and other embodiments, which fall within the true spirit and scope of the invention. Thus, to the maximum extent allowed by law, the scope of the invention is to be determined by the broadest permissible interpretation of the following claims and their equivalents, and shall not be restricted or limited by the foregoing detailed description.

What is claimed is:

1. A method for driving an electrophoresis display device, the method comprising:

applying a reset voltage having a first polarity to an electrophoresis material of the electrophoresis display device for at least one frame period to display a reset image;

applying a first gradation voltage having a second polarity opposite to the first polarity to the electrophoresis material for one frame period to display a first grey image, after the reset image is displayed;

applying a second gradation voltage having the second polarity to the electrophoresis material corresponding to at least one of a plurality of pixel regions of the electrophoresis display device for at least two frame periods to display a second grey image, after the first grey image is displayed; and applying a third gradation voltage having the first polarity to the electrophoresis material corresponding to a portion of the plurality of pixel regions for one frame period to display a third grey image, which is different from the second grey image, after the second grey image is displayed, wherein absolute values of a voltage level of the first gradation voltage, a voltage level of the second gradation voltage and a voltage level of the third gradation voltage are substantially the same as each other, and wherein the electrophoresis display device comprises:

a first substrate including a plurality of pixels corresponding to the plurality of pixel regions;

a second substrate disposed opposite to the first substrate; and the electrophoresis material disposed between the first substrate and the second substrate and corresponding to each of the plurality of pixel regions.

2. The method of claim 1, wherein the second gradation voltage is applied for k frame periods, and wherein k is an even number greater than or equal to 2.

3. The method of claim 2, wherein the second grey image is divided into a plurality of images having different gradations based on a time period during which the second gradation voltage is applied to the electrophoresis material corresponding to each of the plurality of pixel regions.

4. The method of claim 2, wherein the reset voltage has a voltage level having an absolute value substantially the same as the absolute values of the voltage level of the first gradation voltage, the voltage level of the second gradation voltage and the voltage level of the third gradation voltage.

5. The method of claim 4, wherein the reset voltage is applied for a time period obtained by adding the frame periods for which the first gradation voltage, the second gradation voltage and the third gradation voltage are applied, respectively.

6. The method of claim 1, wherein, after the second grey image is displayed, the third gradation voltage is applied after a first blank period during which a voltage is not applied to the electrophoresis material.

7. The method of claim 1, wherein the reset image is a white image or a black image.

8. The method of claim 1, further comprising applying a first reverse voltage having the second polarity to the electrophoresis material corresponding to at least one of the plurality of pixel regions to display a first reverse image having a gradation opposite to a gradation of the reset image, after the third grey image displayed.

9. The method of claim 8, wherein the first reverse voltage has a voltage level having an absolute value substantially the same as the absolute values of the voltage level of the first gradation voltage, the voltage level of the second gradation voltage and the voltage of the third gradation voltage.

10. The method of claim 9, wherein the first reverse voltage is applied for a time period obtained by adding time periods for which the first gradation voltage, the second gradation voltage and the third gradation voltage are applied, respectively.

11. The method of claim 8, wherein, after the third grey image is displayed, the first reverse voltage is applied after a second blank period during which a voltage is not applied to the electrophoresis material.

12. The method of claim 1, further comprising:

applying a second reverse voltage having the first polarity to the electrophoresis material corresponding to at least one of the plurality of pixel regions to display a second reverse image having a gradation substantially the same as a gradation of the reset image, after the third grey image is displayed; and applying a third reverse voltage having the second polarity to the electrophoresis material to display a third reverse image having a gradation opposite to the gradation of the second reverse image, after the second reverse image is displayed.

13. The method of claim 12, wherein the second reverse voltage has a voltage level having an absolute value substantially the same as the absolute values of the voltage level of the first gradation voltage, the voltage level of the second gradation voltage and the voltage level of the third gradation voltage.

14. The method of claim 13, wherein the third reverse voltage has a voltage level having an absolute value substantially the same as the absolute value of the voltage level of the second reverse voltage.

15. The method of claim 13, wherein the second reverse voltage is applied for a time period obtained by adding time periods for which the first gradation voltage, the second gradation voltage and the third gradation voltage are applied, respectively.

16. The method of claim 15, wherein the third reverse voltage is applied for a time period substantially equal to a time period for which the second reverse voltage is applied.

17. The method of claim 12, wherein, after the third grey image is displayed, the second reverse voltage is applied after a third blank period during which a voltage is not applied to the electrophoresis material.

18. The method of claim 1, wherein the electrophoresis material comprises:

a plurality of first electrophoresis particles having a polarity;

a plurality of second electrophoresis particles having a polarity opposite to the polarity of the first electrophoresis particles; and a dielectric solvent in which the first and second electrophoresis particles are dispersed.

19. The method of claim 18, wherein the electrophoresis display device further comprises a separation wall disposed between the first substrate and the second substrate, wherein the separation wall divides a space between the first substrate and the second substrate into a plurality of pixel spaces corresponding to the plurality of pixel regions.

* * * * *